United States Patent [19]

Marchetti

[11] 3,977,162

[45] Aug. 31, 1976

[54] DEVICE FOR CLOSING THE FRONT STRAP OF A PARALLELEPIPED BOX

[76] Inventor: Augusto Marchetti, Piazza Sicilia 7, Milan, Italy

[22] Filed: Apr. 9, 1974

[21] Appl. No.: 459,336

[52] U.S. Cl. ..... 53/374

[51] Int. Cl.[2] ..... B65B 7/20

[58] Field of Search ..... 53/374, 375, 382, 76

[56] References Cited

UNITED STATES PATENTS

| | | | |
|---|---|---|---|
| 1,118,424 | 11/1914 | Johnson | 53/374 |
| 3,775,937 | 12/1973 | Devan et al. | 53/374 X |

*Primary Examiner*—Travis S. McGehee

*Attorney, Agent, or Firm*—Karl W. Flocks

[57] ABSTRACT

There is disclosed a device for closing the front strap of a parallelepiped box. Such device comprises an articulated parallelogram composed of an upper fixed horizontal side, a lower mobile horizontal side and two normally vertical connecting sides. A rotatable arm has its lower end hinged to the inlet end of the lower side of the parallelogram and is also linked to the upper side of the parallelogram by a rigid rod hinged at its ends. The lower side is at a distance from a support surface for the box, which is just less than the height of the box, so that, when the advancing box encounters the inlet end of the lower side of the parallelogram, the lower side is enabled to rise and to cause the rotatable arm to rotate towards the front side of the box to engage the front strap thereof and to move it to the closing position.

1 Claim, 7 Drawing Figures

DEVICE FOR CLOSING THE FRONT STRAP OF A PARALLELEPIPED BOX

This invention relates to a device for closing the front strap of a parallelepiped box.

A parallelepiped box of the type comprising upper straps to be bent over arrives at the exit of the filling station with all the straps open, and is then introduced under these conditions into a closing machine where appropriate devices firstly close the end straps and then the side straps.

For closing the front strap, in particular, devices are mainly used based on the fundamental concept of setting up a condition of impact between a fixed member inserted into the path of advancement of the front strap and the front strap itself. The result of this impact is evidently the bending over of the strap into the closure position. A typical example of a device of this type is the inclined surface described and illustrated in Italian Pat. No. 953635 of Aug. 4, 1972 in the name of the present applicant.

Devices formed in this manner however give rise to the disadvantage of being ineffective where the front strap is very open, in particular at 90° or more to the frontal wall of the box, because they are not able to set up the necessary condition of impact.

The object of the present invention is consequently to provide a device which enables the front strap of a box to be bent over into the closure position, even where the strap is very open (90° or more).

In accordance with the invention this object is attained by a device comprising a surface for the support and advancement of the box, an articulated parallelogram composed of an upper fixed horizontal side, a lower mobile horizontal side and two normally vertical connecting sides for said horizontal sides, a rotatable arm having its lower end hinged to the inlet end of said lower side of the parallelogram and a rigid rod hinged at its ends to said rotatable arm and to said upper side of the parallelogram, said normally vertical sides of the parallelogram and said rigid rod being of such a length as to keep said lower side at rest at a distance from said support surface just less than the height of the frontal wall of the box and said rotatable arm in a position inclined upwards and towards the exit end of said support surface, and, following a horizontal thrust exerted on the inlet end of said lower side of the parallelogram by the frontal wall of the box, allow said lower side to rise to a distance from said support surface just greater than the height of the frontal wall of the box and simultaneously allow said rotatable arm to rotate towards a position inclined upwards towards the inlet end of said support surface.

From this overall description of the device according to the invention it is evident that as the lower side of the parallelogram is normally at a height less than the frontal wall of the box and the rotatable arm is inclined upwards towards the exit end of the support surface, even a very open front strap (for example 90°) manages to rise along the inclined plane defined by the rotatable arm and therefore make a first rotation towards the closure position. When the frontal wall of the box comes into contact with the inlet end of the lower side of the parallelogram and exerts a thrust on it in the direction of advancement of the box, said lower side rises and this enables it to leave the path of advancement of the frontal wall of the box, and simultaneously the rotatable arm rotates towards the position upwardly inclined towards the inlet end of the support surface, so obliging the front strap to make a similar rotation. The closure of the strap is completed when, as the box continues to advance, the lower side of the parallelogram acts with its own weight on the strap.

Thus a device is obtained which, although extremely simple, is perfectly able to bend over the front strap of a box into the closure position, even where the strap is very open.

It should also be noted that as the frontal wall of the box encounters maximum resistance to its advancement during the final stage of raising of the lower side of the parallelogram, at this stage the front strap of the box already having passed beyond its position of coplanarity with said frontal wall, the front strap helps to increase the strength of the upper edge of the frontal wall and avoid the danger of undesirable deformation of the edge.

The characteristics and advantages of the present invention will be more evident from the following detailed description of one practical embodiment illustrated in the accompanying drawings in which.

Figure 1:
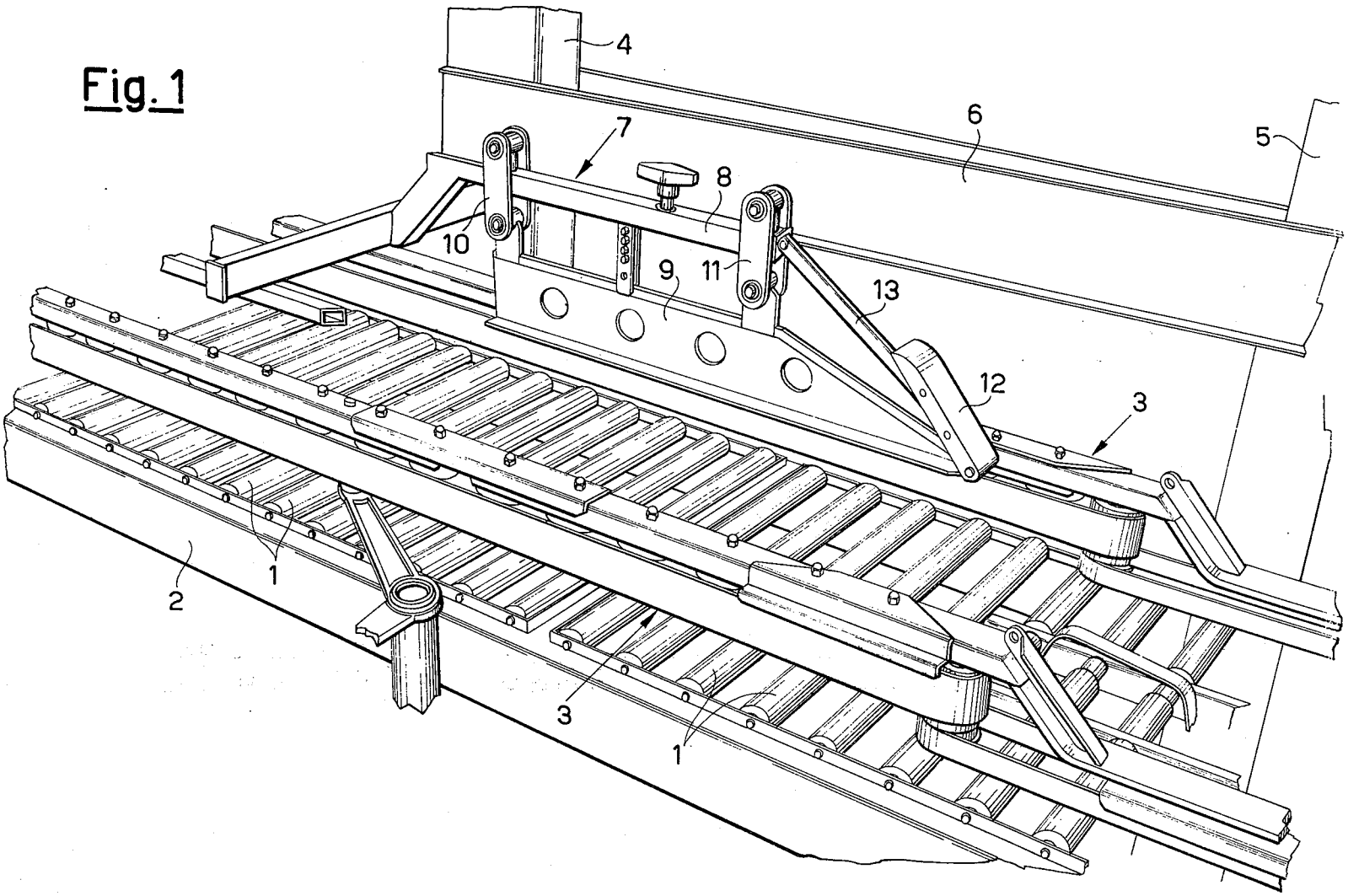
FIG. 1 is a perspective view of a device according to the invention.

The device shown in the drawings comprises a surface for the support and advancement of the boxes, defined by a succession of idle rollers 1 supported by a base frame 2. To the sides of said support surface there are two belt drive assemblies 3, which by known means can be made to approach each other until they engage with the sides of the boxes so as to continuously feed these latter.

Figure 3:
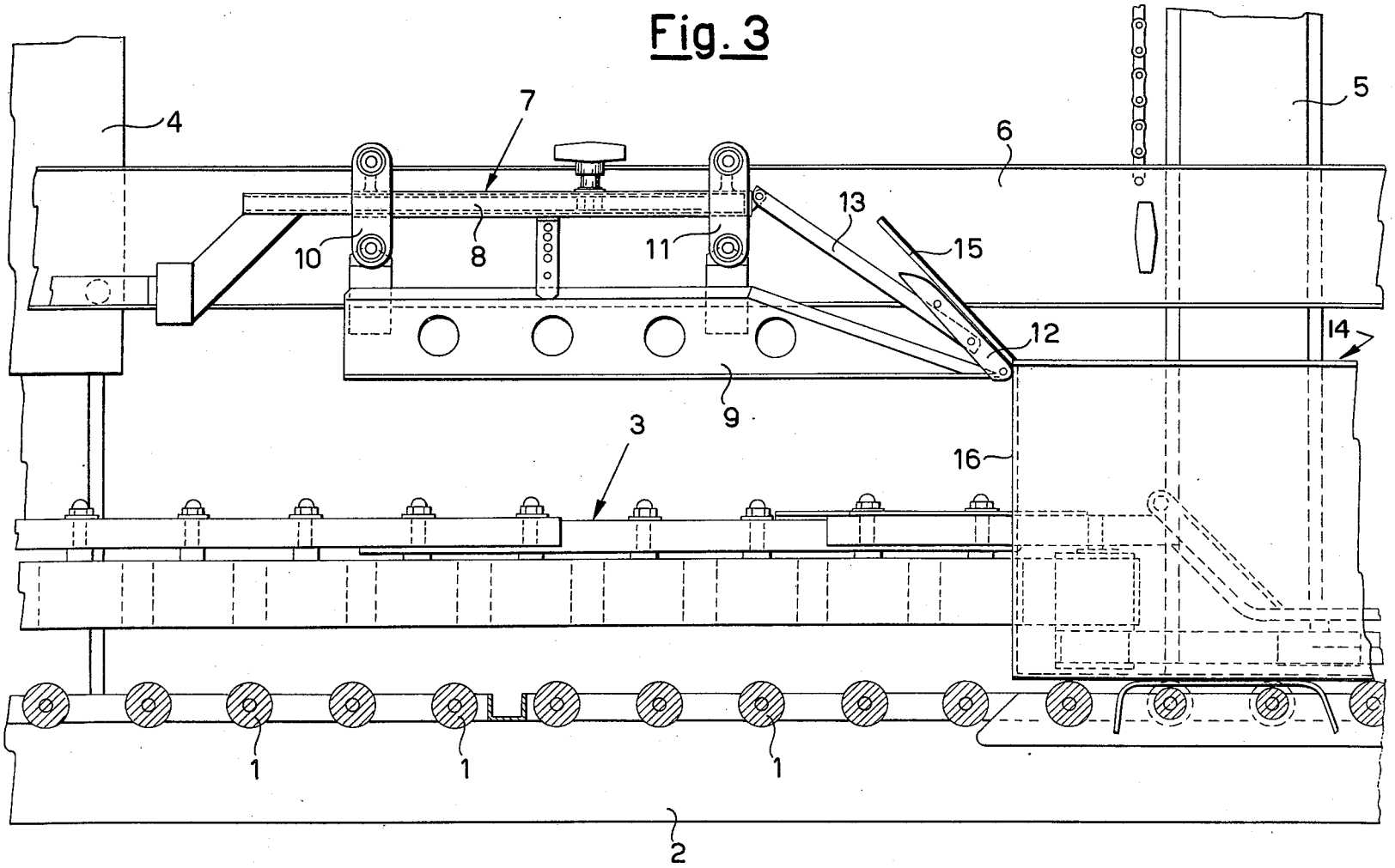
Figure 4:
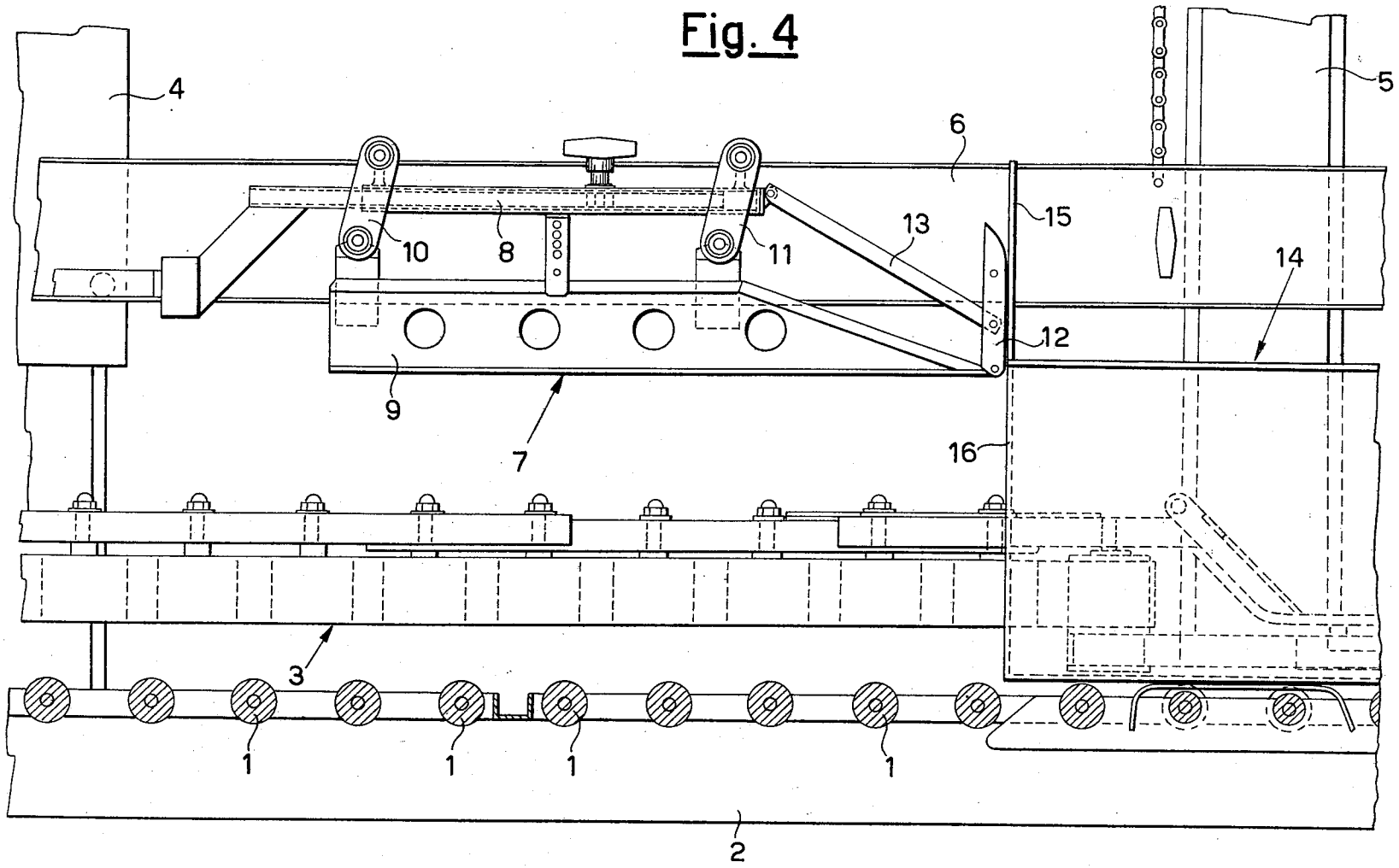
Figure 5:
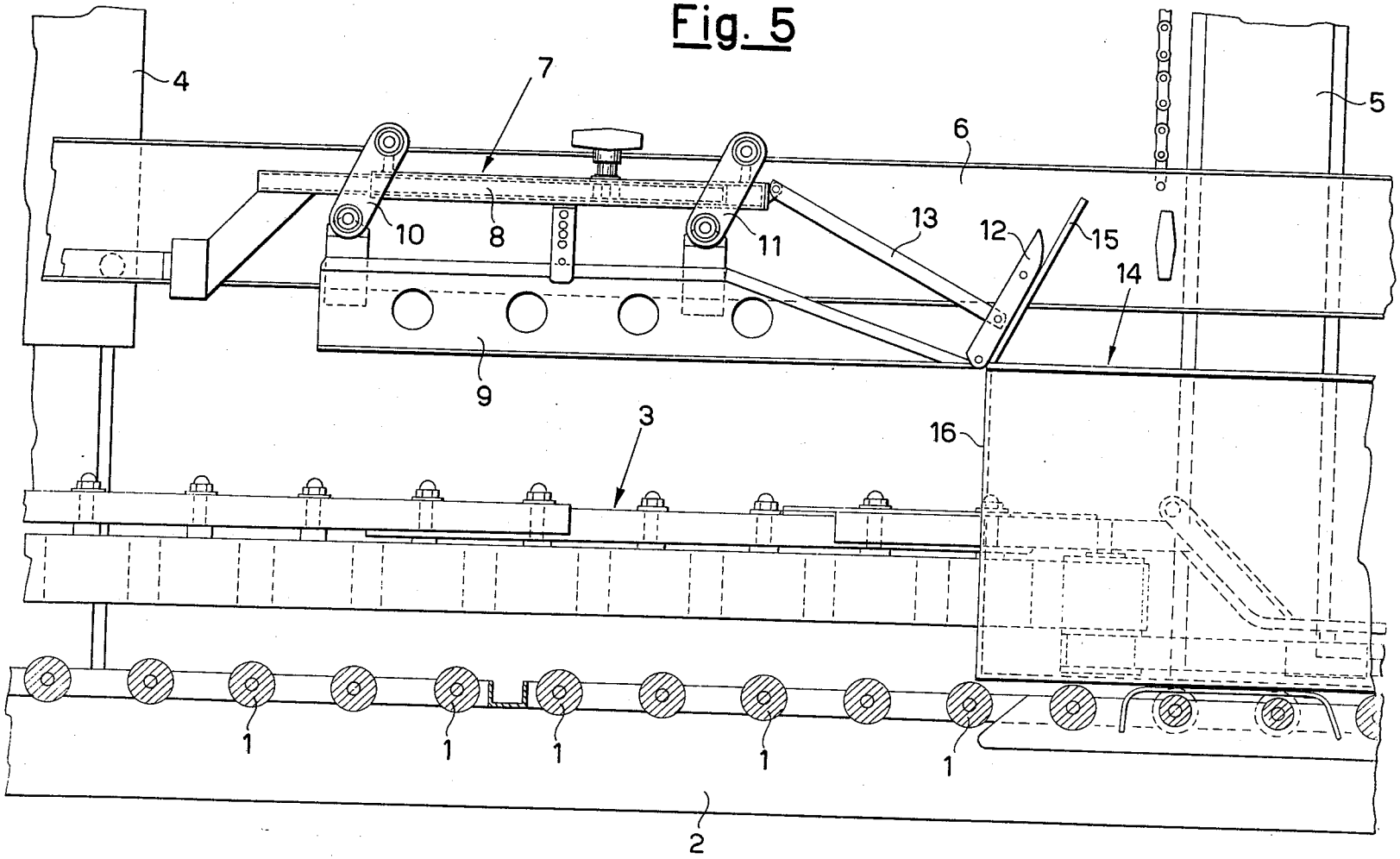
Figure 6:
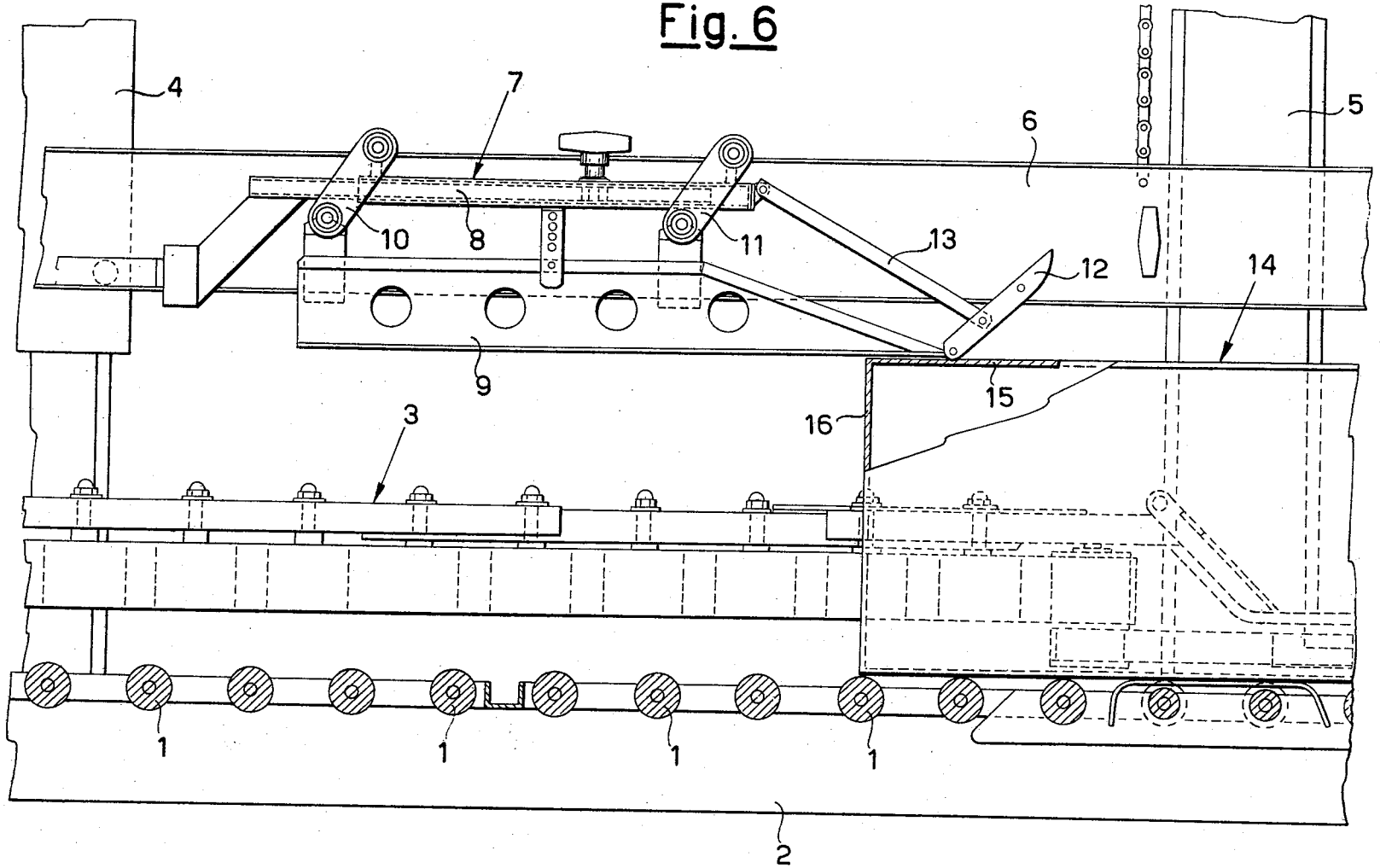

A truss 6 supporting an articulated parallelogram 7 arranged substantially in the central longitudinal vertical plane of the succession of rollers 1 is adjustably fixed to two columns 4 and 5 forming part of the base frame. This parallelogram is composed of an upper fixed horizontal side 8, a lower mobile horizontal side 9 and two normally vertical sides 10 and 11 which form the articulated connection between the two horizontal sides 8 and 9. On the inlet end of the lower side 9 is hinged a rotatable arm 12 which is connected in an articulated manner also to the upper side 8 by a rigid rod 13 hinged at its ends. The length of the two normally vertical sides 10 and 11 and the length of the rigid rod 13 are chosen in such a manner that when the lower side 9 is at rest it is at a distance from the support surface for the boxes which is just less than the height of the frontal wall of the box to be closed and the rotatable arm 12 is in a position inclined upwards towards the exit end of the support surface (FIGS. 1, 2 and 3), and, following a horizontal thrust applied to the inlet end of the lower side 9 by the frontal wall of a box, the lower side 9 rises until it is at a distance from the support surface which is just greater than the height of the frontal wall of the box and the rotatable arm 12 simultaneously rotates towards a position inclined upwards towards the inlet end of the support surface (FIGS. 4–6).

Figure 2:
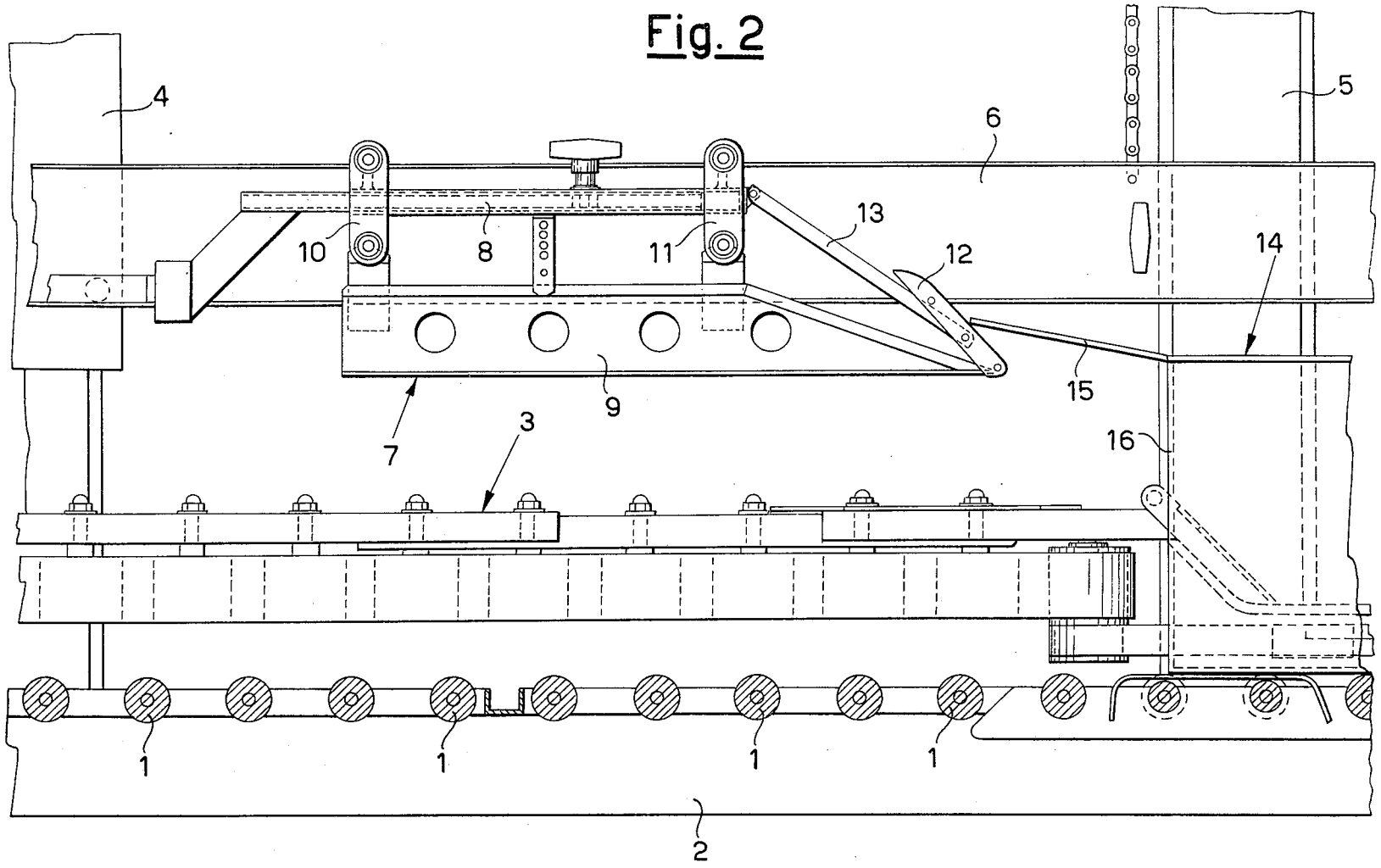
FIGS. 2–7 are lateral views of the same device during different stages of operation.
Figure 7:
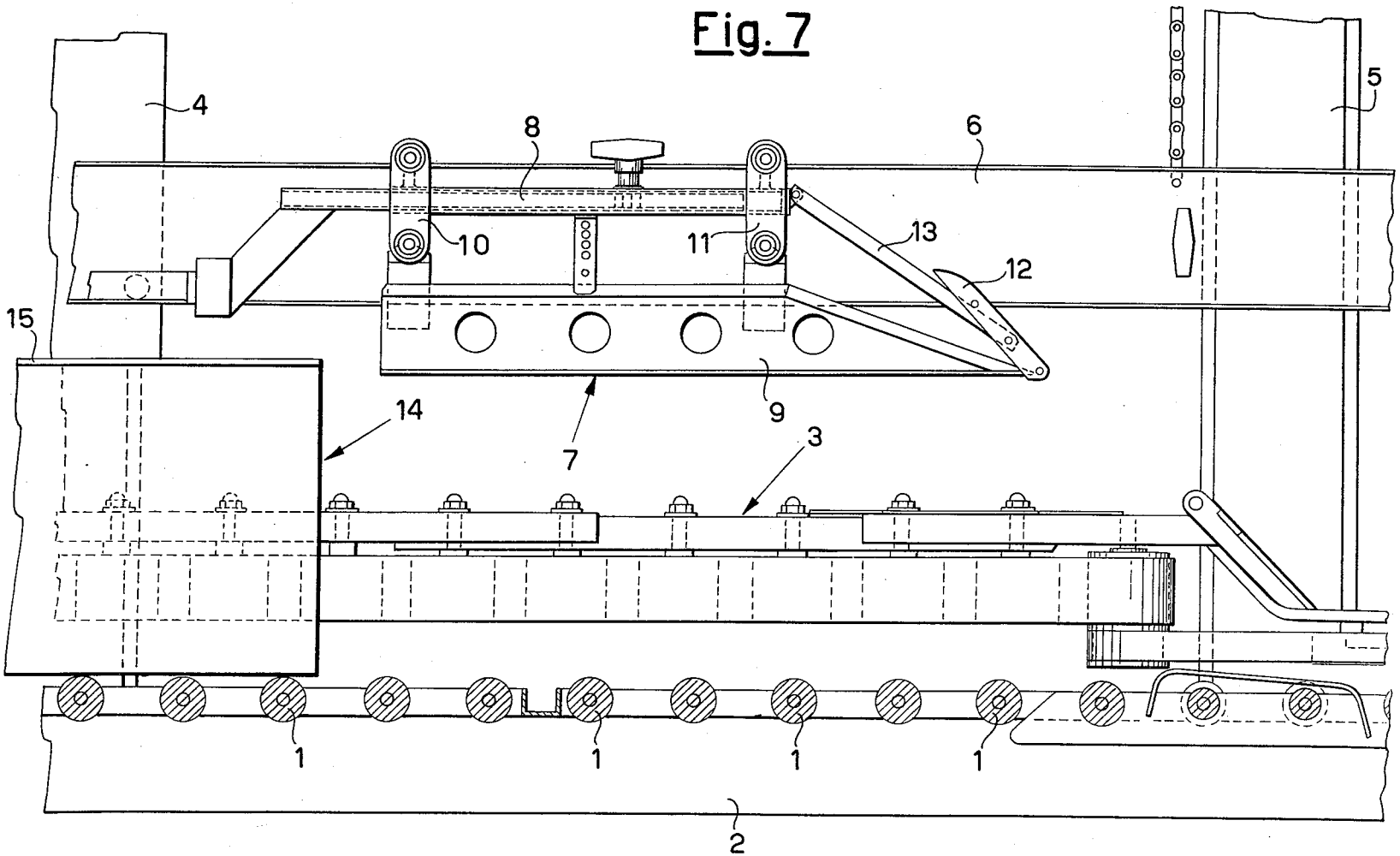

The operation of the device heretofore described is as follows. When a box 14 of which the front strap 15 is to be closed is arranged on and fed along the support surface defined by the rollers 1, the articulated parallelogram 7 and the rotatable arm 12 are evidently in the rest position of FIGS. 1 and 2, i.e. as stated, with its lower side 9 lowered with respect to the upper end of the frontal wall 16 of the box and the rotatable arm inclined upwards towards the exit end of the support surface. Because of this disposition, even a very open front strap such as that shown in FIG. 2 tends to rise along the inclined plane defined by the arm 12 and so make a first rotation towards the closure position (FIGS. 2 and 3). When the frontal wall 16 of the box (or rather its upper edge) comes into contact with the inlet end of the lower side 9 of the parallelogram 7 (FIG. 3) and exerts on it a thrust in the feed direction of the box, the lower side 9 rises and is enabled to leave the path of advancement of the frontal wall of the box (FIGS. 4–6), and simultaneously the arm 12 rotates in the clockwise direction towards a position inclined in the direction opposite that of FIG. 6, so obliging the upper strap 15 to make an analogous rotation towards the closure position (FIGS. 4–6). It should be noted (FIG. 5) that the rising stage of the side 9, during which the frontal wall of the box encounters greatest resistance, is carried out with the front strap already beyond the position of coplanarity with the frontal wall 16 (FIG. 4) and hence under conditions which increase the strength of the upper edge of the wall 16 and so avoid undesirable deformation of the edge. The closure of the front strap 6 is completed when the weight of the lower side 9 of the parallelogram 7 (FIG. 6) acts on the strap as the box continues its advancement. When the box has emerged from under the parallelogram (FIG. 7), this latter finally returns to its rest position.

What I claim is:

1. Device for closing the front strap of a parallelepiped box, comprising a surface for the support and advancement of the box, an articulated parallelogram composed of an upper fixed horizontal side, a lower mobile horizontal side and two normally vertical connecting sides for said horizontal sides, a rotatable arm having its lower end hinged to the inlet end of said lower side of the parallelogram and a rigid rod hinged at its ends to said rotatable arm and to said upper side of the parallelogram, said normally vertical sides of the parallelogram and said rigid rod being of such a length as to keep said lower side at rest at a distance from said support surface just less than the height of the frontal wall of the box and said rotatable arm in a position inclined upwards and towards the exit end of said support surface, and, following a horizontal thrust exerted on the inlet end of said lower side of the parallelogram by the frontal wall of the box, allow said lower side to rise to a distance from said support surface just greater than the height of the frontal wall of the box and simultaneously allow said rotatable arm to rotate towards a position inclined upwards towards the inlet end of said support surface.

* * * * *